United States Patent [19]

Johnston

[11] Patent Number: 4,805,410

[45] Date of Patent: Feb. 21, 1989

[54] CLOSED LOOP RECIRCULATION SYSTEM FOR A WORKING FLUID WITH REGENERATION

[76] Inventor: Barry Johnston, 1622 Q St., N.W., Washington, D.C. 20009

[21] Appl. No.: 150,435

[22] Filed: Jan. 28, 1988

[51] Int. Cl.[4] ..... F01K 21/00; F01K 25/10

[52] U.S. Cl. ..... 60/671; 60/651; 60/670; 60/691

[58] Field of Search ..... 60/651, 670, 671, 654, 60/691

[56] References Cited

U.S. PATENT DOCUMENTS

| | | | |
|---|---|---|---|
| 4,006,595 | 2/1977 | Forbes | 60/651 |
| 4,270,350 | 6/1981 | Chevalier | 60/671 X |
| 4,698,973 | 10/1987 | Johnston | 60/671 X |

*Primary Examiner*—Allen M. Ostrager
*Attorney, Agent, or Firm*—Lowe, Price, LeBlanc, Becker & Shur

[57] ABSTRACT

An improved closed loop thermodynamic system that recirculates the vaporizable working fluid between its liquid and vapor states include a thermal regeneration unit that receives vaporized working fluid after its utilization and transfers a portion of the enthalpy contained therein to condensate, the pressure of which has been raised to the highest vapor pressure in the closed loop system by communication with a vaporizing unit therein. The vaporized working fluid, from which the regenerative heat has thus been extracted, is then directed to a condensing unit of known type for condensation therein and any incidental condensation formed during the course of the regenerative heat transfer from the vaporized working fluid is collected in a separate portion of the regeneration unit and is periodically transferred to join the condensate flowing from the condensing unit to the regeneration unit for regenerative heating therein. This improved closed loop recirculating thermodynamic system effects all fluid transfers by natural convection, force of gravity, and judicious application of the highest and lowest pressures available within the system by selective communication between portions of the system.

14 Claims, 2 Drawing Sheets

DOUBLE ACTING PUMP

CLOSED LOOP RECIRCULATION SYSTEM FOR A WORKING FLUID WITH REGENERATION

TECHNICAL FIELD OF THE INVENTION

This invention relates generally to systems for recirculating a working fluid undergoing phase changes in a closed thermodynamic system and, more particularly, to a closed loop recirculation system in which a working fluid is subjected to thermal regeneration so that the working fluid in its liquid state is preheated prior to vaporization by recovery of a portion of the enthalpy contained in the vaporized working fluid that has performed its useful function in a closed cycle through selective application of relatively high and low pressures within the system

BACKGROUND OF THE PRIOR ART

Closed loop thermodynamic systems utilizing a vaporizable fluid, for the transfer of energy from an energy source to an energy utilizing means or for conversion of energy from thermal energy to mechanical energy, are well known. Such systems are particularly suited for solar energy conversion establishments in remote locations.

Typically, in a closed loop thermodynamic system of the type contemplated in relation to the present invention, a vaporizable working fluid undergoes a change of state from its liquid to its vapor form and back during a complete thermodynamic cycle. The system typically includes a boiler or other comparable element that receives thermal energy from an external energy source (e.g., the sun or a furnace) to vaporize the working fluid from its liquid to its vaporized state, and energy utilizing means (e.g., an engine or radiator) connected to the boiler to receive the vaporized working fluid therefrom at a relatively high specific enthalpy, a condenser or the like that serves as a heat sink and condenses exhausted vaporized working fluid to its liquid state following its productive use in the heat utilizing means and appropriate well known piping and means (e.g., a pump or natural convection) to transfer the condensed working fluid back to the boiler.

As persons skilled in the art must know, in such a closed loop thermodynamic system the Second Law of Thermodynamics requires that at least a portion of the energy received from the external energy source be rejected to a low temperature heat sink for the thermodynamic cycle to repeat itself. Such persons would also appreciate that the newly formed condensate in the condenser is at a relatively low pressure in the system and that cyclical operation of the system requires that the pressure of this liquid working fluid be raised to the working pressure of the boiler.

It is also well known in the thermodynamic arts that thermal regeneration, i.e., a transfer of some of the heat that has to be surrendered by the system to the low temperature heat sink into the condensate prior to its entry into the boiler has the effect of increasing the thermodynamic efficiency of the system. This step of thermal regeneration is most effective, under most practical operating conditions, when the regenerative heat transfer causes energy to be added to the condensate after its pressure has been raised to essentially its highest value.

Closed loop thermodynamic systems, particularly for solar energy conversion establishments, tend to operate at relatively low temperatures and may utilize liquids other than water as the working fluid. Fluids found to be relatively convenient for such uses include freons and ammonia. Obviously, leakage of such a working fluid from the system can be both expensive and undesirable in that it would release a pollutant to the atmosphere Although sealed pumps are known and available, they must always be well sealed to be effective and will require periodic maintenance with consequential interruption in the operation of the overall system. Under such circumstances, it is highly desirable to have a closed loop system in which the working fluid is recirculated by a judicious combination of the force of gravity and the pressure differences available within the system itself.

An example of such a system, titled "Closed Loop Solar Collective System Powering a Self-Starting Uniflow Engine", U.S. Pat. No. 4,698,973 was issued to me on Oct. 13, 1987. It is incorporated herein by reference for its teaching of a non-regenerative closed loop thermodynamic system, the efficiency of which can be improved by the provision of thermal regeneration as disclosed and claimed herein. In this prior art system, the boiler element contains liquid working fluid approximately at a level at which two interconnected and cooperating working fluid holding tanks are located below a condenser element. A uniflow reciprocating vapor driven engine is utilized as an exemplary heat utilizing device in this known system.

There is, however, a need for an improved closed loop recirculation system in which the working fluid is provided with thermal regeneration, in which working fluid holding tanks combine with the rest of the system and a regenerator to utilize the boiler and condenser pressures and the force of gravity to effect recirculation with thermal regeneration in a safe, reliable and efficient manner without the use of a separate pump element to effect the necessary working fluid flows.

DISCLOSURE OF THE INVENTION

Accordingly, it is an object of this invention to provide a closed loop recirculation system for a working fluid with thermal regeneration.

It is another object of this invention to provide a closed loop recirculation system for a working fluid provided with thermal regeneration, wherein the system operates by natural convection supplemented by the application of relatively high and low pressures available within the system.

It is a further object of this invention to provide a closed loop recirculation system for a working fluid wherein heat transfer for thermal regeneration of the working fluid is effected by transferring heat from exhausted working fluid vapor to condensed working fluid at approximately the highest working fluid pressure in the system.

These and other objects of this invention are realized by providing in a closed loop thermodynamic system, in which a recirculating working fluid undergoes changes between its liquid and vapor phases in a working cycle, in which energy received from an external energy source is utilized to vaporize the working fluid at a high pressure in a boiler unit and the vapor is utilized in an energy utilizing device, whereafter the utilized vapor is condensed at a relatively lower pressure in a condensing unit into a condensate returned to the boiler unit for repeating of a thermodynamic cycle, and where the condensate flow between the condensing unit and the boiler unit is collected in one of two holding tanks in selective pressure communication with the boiler unit and the condensing unit such that each holding tank in selective alternation is at the relatively low pressure of the condensing unit while receiving condensate and at the high pressure of the boiler unit while delivering condensate for conveyance thereto, an improvement including a thermal regeneration unit for providing regenerative heating of the condensed working fluid. The system topology allows the energy utilizing device to be locatable above or below the condensing unit as convenient. The regeneration unit according to a preferred embodiment of this invention is formed to have a first portion with a passage having a thermally conductive wall and connected to the energy utilizing device to transfer the utilized vapor to a second portion of the thermal regeneration unit connected to the condensing unit to transfer thereto at least a portion of said received utilized vapor, the first portion of the regeneration unit being selectively connectable to one of the two holding tanks to receive any condensate delivered therefrom for regenerative heating thereof by energy transferred thereto from the received utilized vapor across the thermally conductive wall. The first portion of the regeneration unit is connected to the boiler unit to deliver regeneratively heated condensate thereto, and the second portion of the regeneration unit communicates with the first portion by way of the passage with the thermally conductive wall, whereby any utilized vapor received therethrough is conveyed to the condensing unit and any incidental condensate formed from this utilized vapor in passage through the first portion is collected within the second portion of the regeneration unit for periodic delivery to the holding tank which is receiving condensate under the influence of the pressure differential between the pressure in the second portion of the regeneration unit and the relatively low pressure of the holding tank receiving condensate at that particular time.

Still other objects and advantages of the present invention will become readily apparent to those skilled in this art from the following detailed description, wherein only the preferred embodiments of the invention are shown and described, simply by way of illustration of the best modes contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DESCRIPTION OF THE PREFERRED EMBODIMENT

Figure 1:
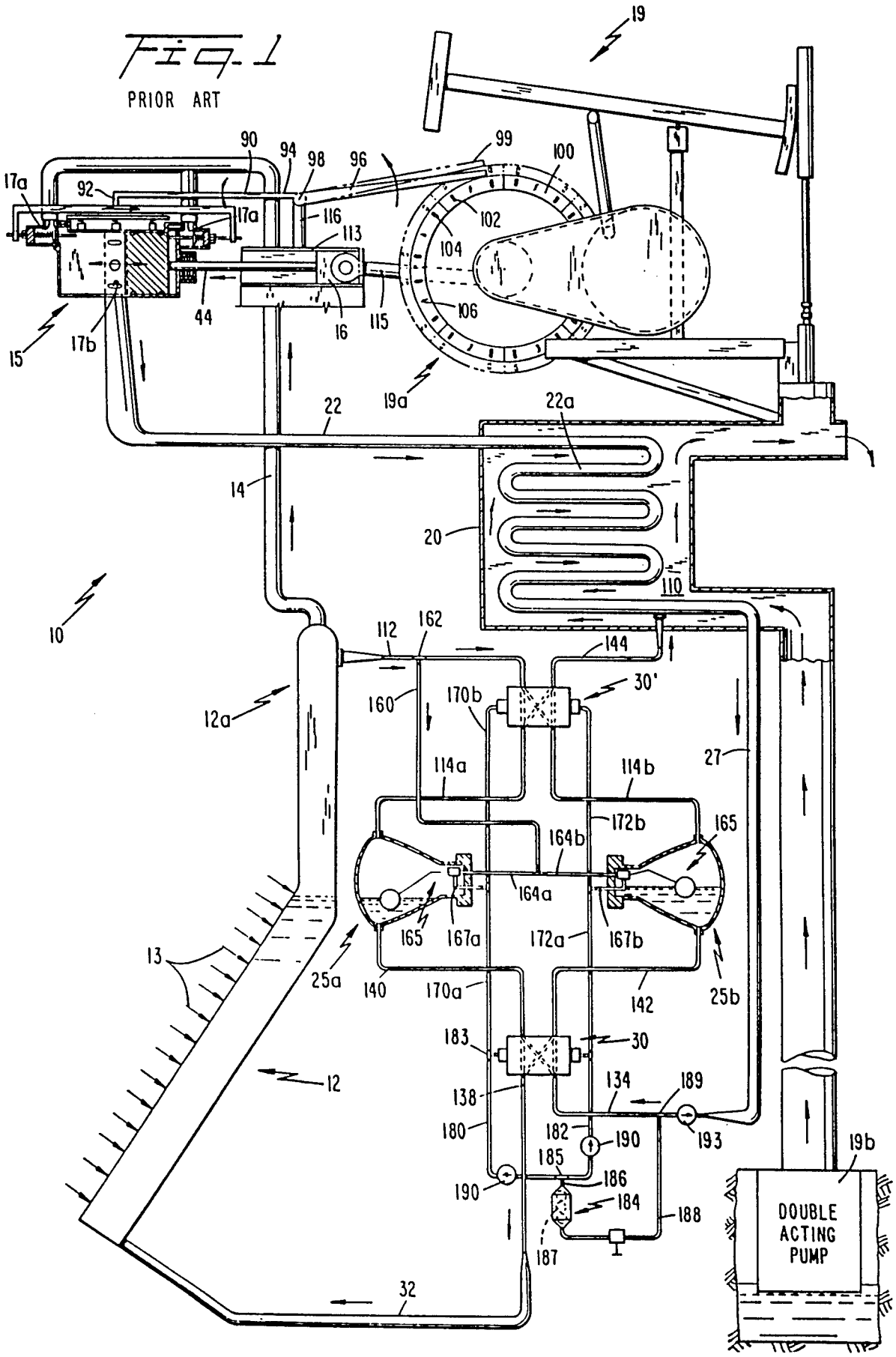
Fig. 1 PRIOR ART
FIG. 1 is a partially sectioned schematic illustration of a closed loop thermodynamic system that includes two cooperating liquid working fluid holding tanks and an exemplary solar energy powered boiler as taught in my patent, U.S. Pat. No. 4,698,973.

An exemplary closed loop energy conversion system, in which a working fluid recirculates without thermal regeneration, as illustrated in FIG. 1, typically comprises a boiler 12 that receives energy 13 (such as sunlight directed to a solar energy collection surface) and utilizes this energy to convert a vaporizable working fluid from its liquid state to its vaporized state in an upper portion 12*a*. This vaporized working fluid is conveyed by a pipe 14 to, for example, a reciprocating engine in which the fluid expands against a slidable piston 16 to cause rotation of a crank shaft coupled to a flywheel 19*a* to deliver mechanical output at a rotating shaft connected thereto. Assorted combinations of valves, linkages and the like, such as elements 15, 19, 96 and the like, may be employed to effect regulation of the engine. Any other heat utilizing means, e.g., a space-heating radiator, a turbine, a chemical heating vat, etc., can serve as a heat utilizing means instead of the exemplary uniflow engine illustrated in FIG. 1.

Exhausted vapor i.e., vapor from which a portion of its enthalpy has been lost in passing through the engine (heat utilizing means), leaves the engine through a series of ports, typified by 17*b*, and is carried through line 22 into a cooled coil 22*a* in a condenser unit 20. A supply of cooling water 110 flows through condenser unit 20 to remove some of the enthalpy contained in the exhausted working fluid vapor to cause the same to change from its vaporized state to its liquid state. The condensed liquid then passes therefrom under gravity, at least in the system illustrated in FIG. 1, and through an assortment of valves and interconnected lines is selectively directed, in alternation, to one of two holding tanks 25*a* and 25*b*. Each of these tanks is selectively connectable to either the high pressure vapor region 12*a* in boiler 12 or the low pressure exhausted vapor region at a point in condenser coil 22*a*.

By judicious manipulation of valves such as 30 and 30', high pressure vapor from boiler 12 is provided into the upper reaches of the holding tank which at that time is discharging condensate to the lower region of boiler 12, while the other holding tank is connected to the low pressure regions of condenser tube 22*a* to apply a vacuum or subatmospheric pressure to facilitate the filling of that tank with condensate condenser 20. A detailed description of the manner in which such a basic system may be operated is provided in my U.S. Pat. No. 4,698,973, the teaching of which is incorporated herein by reference.

It is important to appreciate that the exemplary system illustrated in FIG. 1 does not employ a separate pump element and that, therefore, it is simply a combination of natural convection (this being the consequence of differences in density between cold and hot condensate in different portions of boiler 12 and the difference in densities between the vapor and liquid phases of the working fluid in boiler 12), gravitational forces (as would tend to generate a downward flow of condensate from condenser 20 and eventually into holding tanks 25*a* and 25*b*), and the selected application of relatively high or low system pressures, e.g., by applying boiler pressure from line 112, through valve 30' and line 114*a* to liquid working fluid collected as condensate in tank 25*a* to enable movement thereof through lines 140, valve 30, line 138 and line 132 into boiler 12 or, on the other hand, the application of the relatively low condenser pressure of condenser coil 22*a* through line 144, valve 30', and line 114*b* to holding tank 25*b* to facilitate entry thereinto of condensate from condenser 20 through line 27, valve 193, line 134, valve 30, and line 142 into holding tank 25*b* for eventual discharge therefrom under boiler pressure into boiler 12.

Such a system, therefore, must be structured with certain geometric, i.e., topological, constraints in mind. Specifically, these include the location of condenser 20 to be at all points above holding tanks 25*a* and 25*b*, and the disposition of boiler 12 such that the meniscus of the liquid working fluid therein can be close to the level of the condensate in either of tanks 25*a* and 25*b* (preferably never higher than the highest level attainable by the liquid working fluid in either holding tank). In general, so long as the heat utilizing means does not extract so much enthalpy from the working fluid as to render it substantially liquid, exhausted vapor therefrom will flow freely from the heat utilizing means to the condenser 20 even if the later is located physically higher.

As persons skilled in the art will appreciate, the overall thermal efficiency of any such system, even with the best available technology, will not be very high. Any improvement in the thermal efficiency, while relatively small in absolute terms, therefore represents a significant improvement and is highly desirable if it can be attained without undue expense or complication. The present invention seeks to do exactly this, by adding to the system a very simple thermal regeneration means that is conveniently located at a level below the lowest level attainable by the liquid working fluid in either of two holding tanks comparable to holding tanks 25*a* and 25*b*, and utilizing the highest and lowest available operating pressures within the system to promote additional flows of vapor and liquid working fluid (as described more fully hereinbelow) to transfer some of the residual enthalpy in the exhausted working fluid after it leaves the engine (and in more general terms any heat utilizing means in place of the engine) to increase the enthalpy of liquid working fluid entering the boiler at a relatively high pressure.

Figure 2:
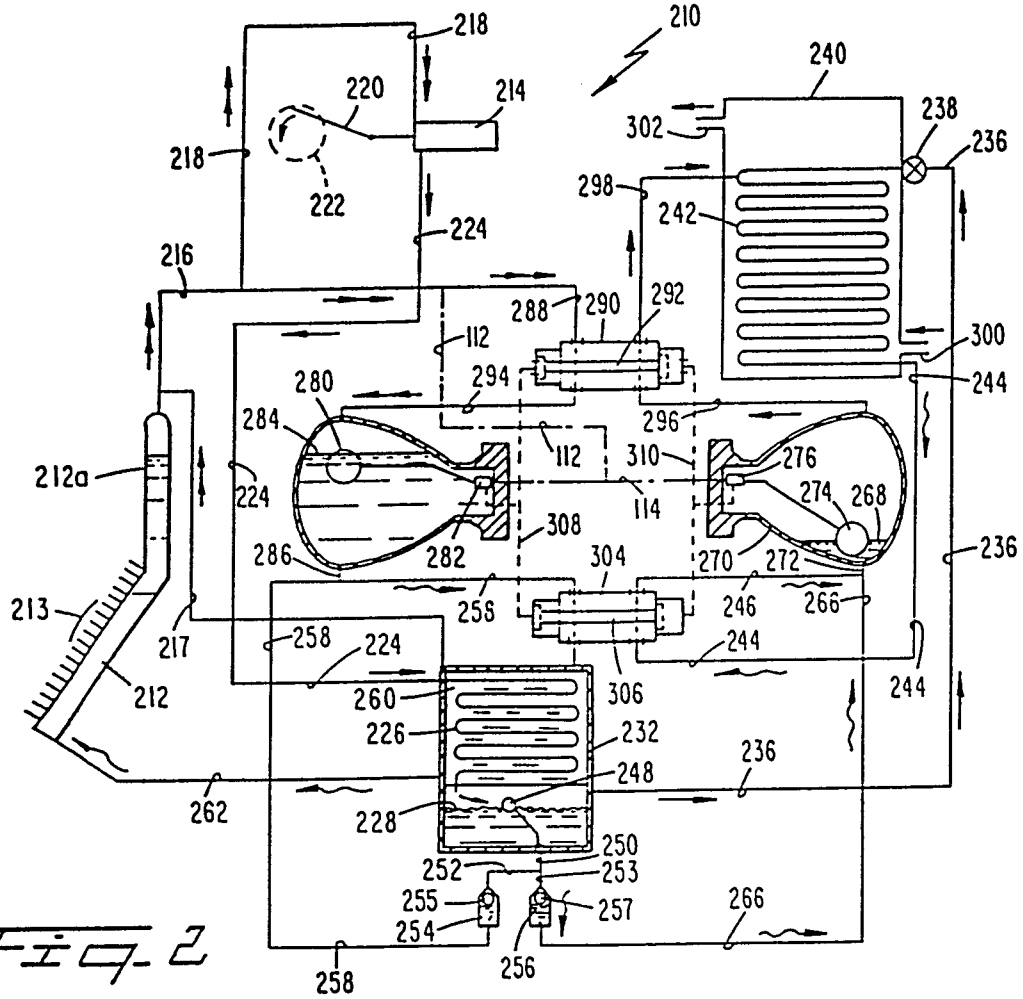
FIG. 2 is a partially sectioned schematic diagram illustrating in relevant part an improvement to the system of FIG. 1, wherein the improvement comprises a thermal regenerator and associated valves and piping according to a preferred embodiment of the present invention.

For ease of distinct reference, various elements in FIG. 2 are numbered with higher order numbers (e.g., the boiler is numbered 212 instead of 12 as in FIG. 1). Also, for the reader's convenience in following the various flows of the working fluid in its liquid and vapor phases, the directions of flow are indicated by arrows that are categorized as follows: straight arrows with two successive heads indicate the direction of flow of high pressure vaporized working fluid; straight arrows with single heads are used to indicate the direction of flow of exhausted working fluid after it leaves a heat utilizing means; arrows with wavy shafts and single heads are used to indicate the direction of flow of liquid working fluid; and arrows with heads and tails are used to indicate the direction of flow of a cool liquid provided from an external source to the condenser to substantially extract the latent heat of condensation from vapor that is to be condensed therein.

Referring now to FIG. 2, the closed loop recirculation system with thermal regeneration includes a vaporizing means 212 that could in one embodiment represent a boiler unit receiving energy 213 from an external source to generate a phase change in the working fluid from its liquid state to its vapor state, the vapor so generated being at the highest pressure in the system and located in the space 212*a* about the miniscus of the liquid working fluid being evaporated therebelow. This high pressure, high enthalpy vapor in a simple system, because it is in contact with the liquid phase, would be saturated vapor. Persons skilled in the art will appreciate that with very little change to the design depicted in FIG. 2, some energy from an external source could be provided to the vapor in the space 212*a* of vaporizing unit 212 to cause the vapor therein to become superheated but at no higher than the saturation vapor pressure thereof. In any event, the high pressure vaporized working fluid leaves the vaporizing unit 212 through line 216 and is available in lines 218 and 288 thereof.

High pressure vaporized working fluid to line 218 enters an energy utilizing means 214, illustrated in FIG. 2 as a reciprocating steam engine having connecting rod 220 for turning a flywheel 222 to provide rotational torque output thereat. As persons skilled in the art will immediately appreciate, it is not necessary that a reciprocating or any particular type of engine be used, and that a heat utilizing means may also be a space-heating radiator, a process element in a chemical plant in which heat is to be provided, and the like.

The heat utilizing means utilizes some of the enthalpy in the high pressure vaporized working fluid and exhausts the working fluid at a somewhat lower enthalpy to an exhaust line 224. In the prior art system of FIG. 1, this exhaust vapor is conveyed directly to a condenser unit in which an external supply of cooling water is utilized to extract sufficient enthalpy to cause a phase change from vapor to liquid condensate for recirculation.

In the present invention, however, the exhausted working fluid, still in its vaporized state, is conducted along line 224 to an exemplary coil 226 made of a thermally conductive material so that heat transfer can take place across the wall thereof. This coil 226 is located in an inside upper portion of thermal regeneration unit 232 in such a manner that a flow of condensate 260 that is to receive thermal regeneration energy from exhausted vapor preferably completely surrounds coil 226. Naturally, occurrence of heat transfer from the exhausted vaporized working fluid in coil 226 to condensate 260 outside it may cause some of the vapor in coil 226 to condense therein. This further energy-exhausted vapor and any incidental condensate so formed are both delivered into a second internal portion of thermal regeneration unit 232 wherein the incidental condensate falls as droplets 228 to be collected in a pool of liquid working fluid 230. The balance of the exhausted vapor flows out of the second portion, preferably located entirely below the first or upper portion, to line 236 and to valve 238 into condenser coil 242.

In the improved system according to the present invention, as in the prior art system, the heat utilizing means 214 can be located to be above or below the condensing means 240 unless the enthalpy removed from the incoming high pressure vapor in the heat utilizing means is so much as to cause the utilized vapor to become substantially a liquid. Even if such a situation were to arise temporarily, e.g., where the heat utilizing means is a space heating radiator in a very cold location and the initial inflow of working fluid thereto is at a rate that is temporarily very low, a conventional condensate trap (not shown) may be provided at the heat utilizing means to be connected to function with the rest of the system in known manner.

Vapor line 217 connects the highest point in the upper portion of regenerator unit 232 with the high pressure vapor line 216 at a point no lower than the highest level attainable by liquid working fluid in either of the holding tanks. This prevents any possible buildup of vapor in the upper portion of regeneration unit 232, since any such vapor passes upward to join line 216 while liquid working fluid cannot so rise due to its higher density Although not illustrated in detail in FIG. 2, mainly because the basic structure is essentially as illustrated in comparable portions of FIG. 1, a flow of cooling fluid from an external source is directed into condenser unit 240 from a cooling fluid inlet 300 to surround the external surface of condenser coil 242 to extract heat therefrom and exits condenser 240 through cooling fluid outlet 302.

As persons skilled in the art will appreciate, for the system to run efficiently, the flow of cooling liquid through condenser 240 must be regulated, depending on its temperature and the heat transfer capability of coil 242, so as to remove only sufficient enthalpy from vapor entering condenser coil 242 to reduce it to its liquid state without significant supercooling. Obviously, although this condition is desirable it is not always immediately attainable and some supercooling of the condensate can be expected to occur. As persons skilled in the art will also appreciate, the phase change from the vapor state to the liquid state involves a significant diminution in specific volume of the working fluid and, therefore, generates the lowest pressure in the system in condenser coil 242. Therefore, condensate leaving condenser coil 242 through line 244 is liquid working fluid at the lowest pressure within the system. This flow of condensate is selectively directed by valve 304, in a manner similar to that described in my U.S. Pat. No. 4,698,973 (incorporated herein by reference) in such a manner that the condensate flow enters that one of two holding tanks 270 and 278 which is at that time receiving condensate. Operation of valve 304 thus serves to direct the flow of condensate from line 244 to whichever of the two tanks is at that time receiving condensate. To facilitate filling of the receiving holding tank, e.g., tank 270, valve 290 is operated so that the low pressure present in condenser coil 242 is applied to extract any residual vapor at the upper reaches of holding tank 270 through lines 296, valve 290 and line 298. As a consequence, flow of condensate into holding tank 270 is promoted.

While holding tank 270 is thus filling up with condensate, and valves 304 and 290 are positioned to facilitate this, the same valves, as described in U.S. Pat. No. 4,698,973 (incorporated herein by reference) are directing the discharge of condensate collected in holding tank 278 through line 258 into the upper regions of thermal regeneration unit 232 to receive heat across the thermally conductive walls of wall 226 as described hereinabove.

The discharge of condensate from holding tank 278 through line 286 into line 258 is facilitated by direction of high pressure vaporized working fluid from the upper reaches of boiler 212 through line 216, line 288, valve 290, and line 294 to fill the upper regions of holding tank 278.

In short, boiler pressure acts on condensate in the holding tank that is emptying at any particular time and, simultaneously, condenser pressure facilitates the filling of the other holding tank, for synchronized and alternate operation of the two holding tanks in conjunction with the other elements of the system.

In the system as described hitherto, condensate 260 heated by receiving thermal regenerative energy transfer across the walls of coil 226 flows into vaporizing means or boiler 212 through line 262. Note that the level of liquid in the holding tanks is at all times somewhat higher than the liquid meniscus in vaporizing means 212 and, to overcome the resistance due to internal friction, bends and valves in the pathway between the holding tanks and the vaporizing means 212 is to some extent compensated for by the availability of high pressure vapor to the discharging holding tank.

Referring again to FIG. 2, the lower portion of thermal regeneration unit 232 serves to hold a pool 230 of the incidental condensation from the exhausted vapor passing through coil 226. This incidental condensate pool is discharged through a valve 250 controlled preferably by a float and lever assembly 248. Persons skilled in the art will appreciate that this pool of incidental condensate 230 is subjected to pressure somewhat lower than that referred to so far as the highest pressure in the system because of the reduction in specific volume as the utilized vapor condenses to form the incidental condensate. A float/lever actuated valve 250, actuated by a float 248 connected to a lever, connects to two check valves 254 and 256 through lines 252 and 253, respectively, two such valves in parallel being needed since the system includes two holding tanks as illustrated in FIG. 2. In a preferred embodiment of this invention, check valves 254 and 256 each contain a relatively lightweight ball, e.g., 255 or 257, that will float in condensate 354 to the top and seal and shut off back flow into regeneration unit 232.

The consequence of this is that lever assembly 248 operates valve 250 only to discharge incidental condensate 230 (but no vapor) through either one of lines 252 or 253, whichever is connected to the corresponding check valves 254 and 256 to lines 258 or 266, respectively, to fill whichever of holding tanks 278 or 270 is at that time receiving condensate. Ball floats 255 or 257 provide simple, reliable and inexpensive checks to prevent backward flow of condensate from the holding tanks into the pool of incidental condensate 230 in the lower reaches of thermal regeneration unit 232.

In actual practice, therefore, once a sufficient quantity of energy 213 has been received by the vaporizing means or boiler 212, a supply of high pressure vaporized working fluid is available which can be utilized in an energy utilizing means 214, is then directed to surrender some of its residual enthalpy and provide thermal regeneration of condensate reentering vaporizing unit 212 and is itself essentially directed either to condenser coil 242 to become condensate or, to the extent that it has already condensed, is collected at the pool of incidental condensate 230 and subsequently rerouted to join the other condensate.

It should be appreciated that the improved system according to this invention does not require an externally powered pump even to effect transmission of incidental condensate 230 from the lower portion of the regeneration unit 232 to a physically higher holding tank. The actual flow of incidental condensate 230 to the particular holding tank receiving the same is, in fact, obtained by the influence of the positive pressure difference or pressure differential between the pressure in the second portion of the regeneration unit 232 (essentially close to the pressure of the exhausted vapor above incidental condensate 230) and the relatively low pressure in the holding tank then in communication with the condensing unit 240.

Figure 3:
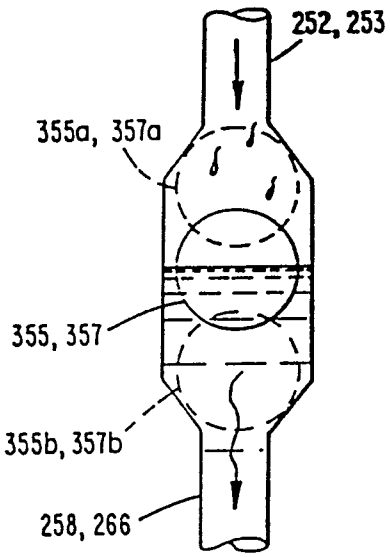
FIG. 3 is a vertical cross-sectional view of a preferred form of a floating-ball type of check valve used to automatically control part of the working fluid flow in the present invention.

Referring now to FIG. 3, it is seen that an alternative, to having both the float/lever actuated valve 250 (to prevent outflow of vapor from the lower portion of regeneration unit 232) and check valves 254, 256 (to prevent backflow of condensate from the holding tanks into the incidental condensate pool 230), is to have two two-way float-equipped check valves only, i.e., to omit the float/lever actuated valve 250 entirely. FIG. 3 illustrates in vertical cross-section the essential details of such a two-way check valve 354 or 356 to be used in place of valves 254, 256 in the first embodiment described earlier.

In the preferred embodiment, valve 354 (valve 356 being similar) has a generally cylindrical body portion ending in generally conical narrowing sealing portions 360 and 362 at opposite ends, the narrow ends of the latter being connectable to lines 252 and 258 as indicated in FIG. 2. A float 355 or 357, illustrated in FIG. 3 as spherical but capable of other suitable shapes, has a diameter smaller than the inside diameter of the cylindrical portion of the valve body so as to be free to float within while allowing condensate to flow past. The float diameter is large enough, however, to seal against conical end portions 360 or 362 when in forced contact therewith.

Under normal operation the pressure on the incidental condensate 230 will either cause flow thereof past the float 355 or the float in position 355a will seal at the conical surface 360 and prevent backflow of condensate from the connected holding tank. However, if for some reason all the incidental condensate 260 has flowed out of the regeneration unit 232 then float 355 will drop into contact with lower conical surface 362 and be held there in the position indicated as 355*b* by pressure of the vapor that will now be filling the lower portion of regeneration unit 232. Recall that when two such two-way float-equipped check valves 354, 356 are used, float/lever actuated valve 250 is omitted.

By this system and the technique described hereinabove, some of the enthalpy in the exhausted vaporized working fluid which otherwise would have been transferred into the cooling fluid flow in condensing means 240 and lost to the system is saved by its transfer into the condensate that is entering vaporizing means 212. Since the condensate entering vaporizing unit 212 is at a somewhat higher temperature than it would be without the regeneration provided by the present invention, either less energy 213 is required at the same output or, as is more likely, thermal regeneration to heat the condensate ensures that the higher temperature/pressure and/or more enthalpy in the vaporized working fluid is being directed to the heat utilizing means. In either case, the overall thermal efficiency of the system is significantly improved.

Throttle valve 238 is used to throttle the inflow of working fluid vapor (no matter where this vapor comes from within the system) so as to ensure that a desired value or level of pressure differential is maintained between the lower portion of the regeneration unit 232 and the holding tank receiving liquid working fluid therefrom, this pressure differential providing the motivation for such flow.

As persons skilled in the art will appreciate, a variety of valves, of known kind, may be utilized as valves 290 and 304 as described herein. Likewise, other types of flow control than the float assemblies 280 and 274 illustrated in FIG. 2 in holding tanks 278 and 270, respectively, can be advantageously employed. Other such modifications or alternatives will be readily apparent to persons skilled in the art without undue experimentation.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. In a closed loop thermodynamic system, wherein a recirculating working fluid undergoes changes between its liquid and vapor phases in a working cycle, in which energy received from an external energy source is utilized to vaporize the working fluid at a high pressure in a vaporizing means and the vapor is utilized in an energy utilizing means, whereafter the utilized vapor is condensed at a relatively lower pressure by a condensing means into a condensate returned to the vaporizing means for repeating of a thermodynamic cycle, and wherein the condensate flow intermediate the condensing means and the vaporizing means is collected in one of two holding tanks that are in selective pressure communication with the vaporizing means and the condensing means such that each holding tank in selective alternation is at the relatively low pressure of the condensing means while receiving condensate therefrom and at the high pressure of the vaporizing means while delivering condensate for conveyance to the vaporizing means, wherein the heat utilizing means is locatable above or below the condensing means as convenient, an improvement comprising:

thermal regeneration means for providing regenerative heating of the working fluid in the form of a condensate, the regeneration means being formed to have a first portion having a passage with a thermally conductive wall and connected to the energy utilizing means to transfer the utilized vapor therefrom to a second portion of the thermal regeneration means that is connected to the condensing means to transfer thereto at least a portion of said received utilized vapor, the first portion of the regeneration means being selectively connectable to a delivering one of the two holding tanks to receive any condensate delivered therefrom for regenerative heating of such received condensate by energy transferred thereto from the received utilized vapor across the thermally conductive wall, the first portion of the regeneration means being connected to the vaporizing means to deliver regeneratively heated condensate thereto, the second portion of the regeneration means communicating with the first portion by way of the passage with the thermally conductive wall whereby any utilized vapor received therethrough is conveyed to the condensing means and any incidental condensate formed from this utilized vapor due to energy transfer therefrom in the first portion of the regeneration means is collected within the second portion of the regeneration means for periodic delivery in selective alternation to that holding tank which is receiving condensate under the influence of the pressure differential between the pressure in the second portion of the regeneration means and the relatively low pressure in the holding tank that is filling at that particular time.

2. The improved closed loop thermodynamic system according to claim 1, wherein:

the regeneration means is located below the lowest level attainable by liquid working fluid in either of the holding tanks, the vaporizing means extends vertically to have a vapor-containing portion thereof extending to a height higher than said lowest level attainable in either of said holding tanks by the liquid working fluid therein, and the lowest level at which condensate is present in the condensing means is higher than the highest level attainable by liquid working fluid in either of the holding tanks.

3. The improved closed loop thermodynamic system according to claim 2, further comprising:

first valve means in the second portion of the regeneration means for limiting outflow therefrom to only the collected incidental condensate to be directed to that one of said holding tanks which is receiving condensate at the relatively low pressure of the condensing means.

4. The improved closed loop thermodynamic system according to claim 3, wherein:

the first valve means comprises a float and lever actuated valve acting in response to the level of collected incidental condensate present in the second portion of the regeneration means.

5. The improved closed loop thermodynamic system according to claim 4, further comprising:

second and third valve means connected in parallel to the first valve means and respectively connected separately to the two holding tanks to ensure that flow of incidental condensate is directed only from the second portion of the regeneration means to the respective holding tanks and not in the reverse direction.

6. The improved closed loop thermodynamic system according to claim 2, further comprising:

first and second two-way check valve means each comprising a body freely floatable in liquid working fluid so as to prevent flow of liquid working fluid from one of the holding tanks into the regeneration means when in a liquid-sealing position and to prevent flow of working fluid vapor from the regeneration means to one of the holding tanks from the regeneration means when in a vapor-sealing position.

7. The improved closed loop thermodynamic system according to claim 6, wherein:

the floatable body in each of the second and third valve means is loosely contained in a valve housing formed to have a generally conical inside upper liquid-sealing surface sealingly contactable by the floatable body in the liquid-sealing position and a generally conical inside lower vapor-sealing surface contactable by the floatable body in the vapor-sealing position, such that when the floatable body is intermediate the liquid-sealing and vapor-sealing positions flow of liquid from the regeneration means occurs past the floating body.

8. The improved closed loop thermodynamic system according to claim 7, wherein:

the floatable body has the form of a sphere.

9. The improved closed loop thermodynamic system according to claim 3, further comprising:

throttle means for throttling the flow of vaporized working fluid into the condensing means, whereby the pressure differential is maintained at a predetermined level.

10. The improved closed loop thermodynamic system according to claim 1, wherein:

the heat utilizing means comprises engine means for converting thermal energy obtained from the enthalpy of the vaporized working fluid received from the vaporizing means into mechanical power.

11. The improved closed loop thermodynamic system according to claim 1, wherein:

the vaporizing means comprises a solar energy conversion means for receiving and absorbing incident solar energy for vaporizing the working fluid.

12. The improved closed loop thermodynamic system according to claim 11, wherein:

the working fluid is water.

13. The improved closed loop thermodynamic system according to claim 11, wherein:

the working fluid is freon.

14. The improved closed loop thermodynamic system according to claim 11, wherein:

the working fluid is ammonia.

* * * * *